United States Patent [19]

Connell et al.

[11] Patent Number: 5,005,124

[45] Date of Patent: Apr. 2, 1991

[54] METHOD AND APPARATUS FOR CATEGORIZING AND CERTIFYING MAIL

[75] Inventors: Richard A. Connell, South Salem; Raymond Keating, Purdys, both of N.Y.; Ronald P. Sansone, Weston; Karl H. Schumacher, Westport, both of Conn.

[73] Assignee: Pitney Bowes Inc., Stamford, Conn.

[21] Appl. No.: 234,977

[22] Filed: Aug. 23, 1988

[51] Int. Cl.[5] ..... G06F 15/21

[52] U.S. Cl. ..... 364/401; 209/584; 209/900

[58] Field of Search ..... 209/900, 584; 364/401, 364/406, 464.02, 464.03; 382/1

[56] References Cited

U.S. PATENT DOCUMENTS

| | | | |
|---|---|---|---|
| 3,901,797 | 8/1975 | Storace et al. | 209/900 |
| 4,136,780 | 1/1979 | Hunter et al. | 209/900 |
| 4,319,328 | 3/1982 | Eggert | 364/466 |
| 4,377,214 | 3/1983 | Hansen et al. | 177/25 |
| 4,516,209 | 5/1985 | Scribner | 209/900 |
| 4,516,264 | 5/1985 | Corvari et al. | 382/46 |
| 4,580,226 | 4/1986 | Bennison | 364/478 |
| 4,780,828 | 10/1988 | Whisker | 364/464.02 |
| 4,821,195 | 4/1989 | Baer et al. | 364/464.02 |
| 4,908,768 | 3/1990 | Gelfer et al. | 364/464.03 |

*Primary Examiner*—Jerry Smith
*Assistant Examiner*—David Huntley
*Attorney, Agent, or Firm*—Peter Vrahotes; Melvin J. Scolnick; David E. Pitchenik

[57] ABSTRACT

An apparatus and method for categorizing and certifying a batch of mail uses a random statistical scheme. The mail will be categorized in terms of print quality, accuracy with the statement sheet accompanying the mail, deliverability, and the like so that the Post Office is relieved of having to manually inspect the mail and can arrange scheduling, equipment and manpower for the processing of such batch of mail. The mail will be certified with regard to the correctness of postage for mailing the batch.

34 Claims, 4 Drawing Sheets

PROGRAM FOR COMPLIANCE AND CATEGORIZATION

MAIL BATCH DELIVERABILITY

METHOD AND APPARATUS FOR CATEGORIZING AND CERTIFYING MAIL

BACKGROUND OF THE INVENTION

Throughout the history of the Post Office, there has been a gradual development whereby the Post Office encourages mailers to prepare their mail in such a way as to reduce the effort required on the part of the Post Office for processing such mail. As an inducement to the mailer to prepare the mail in such a manner so as to bring about faster mail delivery, the Post Office offers mailers a discount on such items as pre-sorted mail, printing of zip codes and pre-printed bar codes to augment automatic processing with machines such as optical character recognition (OCR) sorters and bar code readers and sorters.

Even with the present reduced postage rates for pre-sorted zip code mail and the like, the Post Office is experiencing difficulties in processing the mail not only because of the ever increasing volume of mail that is required to be delivered, but also because a significant amount of mail presented to the Post Office is not in compliance with postal regulations regarding acceptability for automatic processing. Checking compliance of the mail and accuracy of postage paid for the bulk mail had to be done manually. To overcome these problems, the Post Office has gone to large mailers and industries involved in the manufacture of equipment for the processing of mail for the purpose of creating schemes whereby the Post Office and mailer could work closely together to reduce the burden upon the Post Office as a result of such increasing volumes of mail, to reduce non-compliant mail that is presented to the Post Office and to eliminate manual acceptance procedures now required by the Post Office.

SUMMARY OF THE INVENTION

A system and method has been conceived whereby mail will be categorized and certified to allow the Post Office to eliminate its manual acceptance procedures and promote greater efficiencies in its scheduling, equipment and manpower. By categorizing it is meant the physical parameters of the mail, such as size, readability and the like will be checked and recorded. By certifying it is meant the checking of postage paid, the compliance standards being met and the like. In the past, the mail has been delivered to the Post Office by the mailer without the Post Office having any forewarning as to the accuracy of payment, quantity of mail, and the deliverability of such mail. As a result, the Post Office had no way of scheduling its mail and simply had to process the mail as it was received and manually determine accuracy of postage payment. This led to certain inefficiencies because the Post Office did not know how it was to schedule its manpower, and was not sure which of its equipment should process which batch of mail. For example, many large Post Offices and selected postal centers have sorters with optical character reading capability, OCR machines. As one might imagine, not all OCR machines are the same. Some are able to handle more efficiently mail that has low contrast, whereas, other OCR machines require high contrast in the address line. By having a report as to the quality of mail, particularly the contrast of the printing on the address line, the Post Office could arrange to have the mail sent to an OCR machine that could best process the mail. Other types of variations are font type and reflectivity. Another problem has to do with manpower. If the Post Office is aware that high quantities of mail are to be received in the near term, it can arrange its manpower to accommodate such mail. On the other hand, if large volumes of mail are not going to be received, then the manpower can be diverted to other activities. More importantly, a certification report would eliminate the need for manual acceptance.

To accommodate the Post Office in this manner, a system has been devised whereby a batch of mail will be sampled for the purpose of determining the quantity of mail, the quality of mail in terms of readability, and the deliverability of such mail in terms of the accuracy of the addresses printed on the mail. The size of the mail pieces will be determined to assure that they are within the specifications of the Post Office regulations. Upon these quality and quantity parameters being determined, a report will be at the disposal of the Post Office that would include a certification for the postage required for the mail. With such a report, the Post Office is then in a position to arrange scheduling of both the equipment and manpower for the purpose of handling the mail. Although mail from an individual mailer alone will not affect the operation of the Post Office greatly, when one considers that a given Post Office will handle hundreds of large mailers a day, this concept whereby the mailers provide the Post Office with a forecast of the mail that, is to be received, and a certification of the postage paid will enable the Post Office to be better equipped to handle such mail.

DETAILED DESCRIPTION OF THE PREFERRED EMBODIMENT

Figure 1:
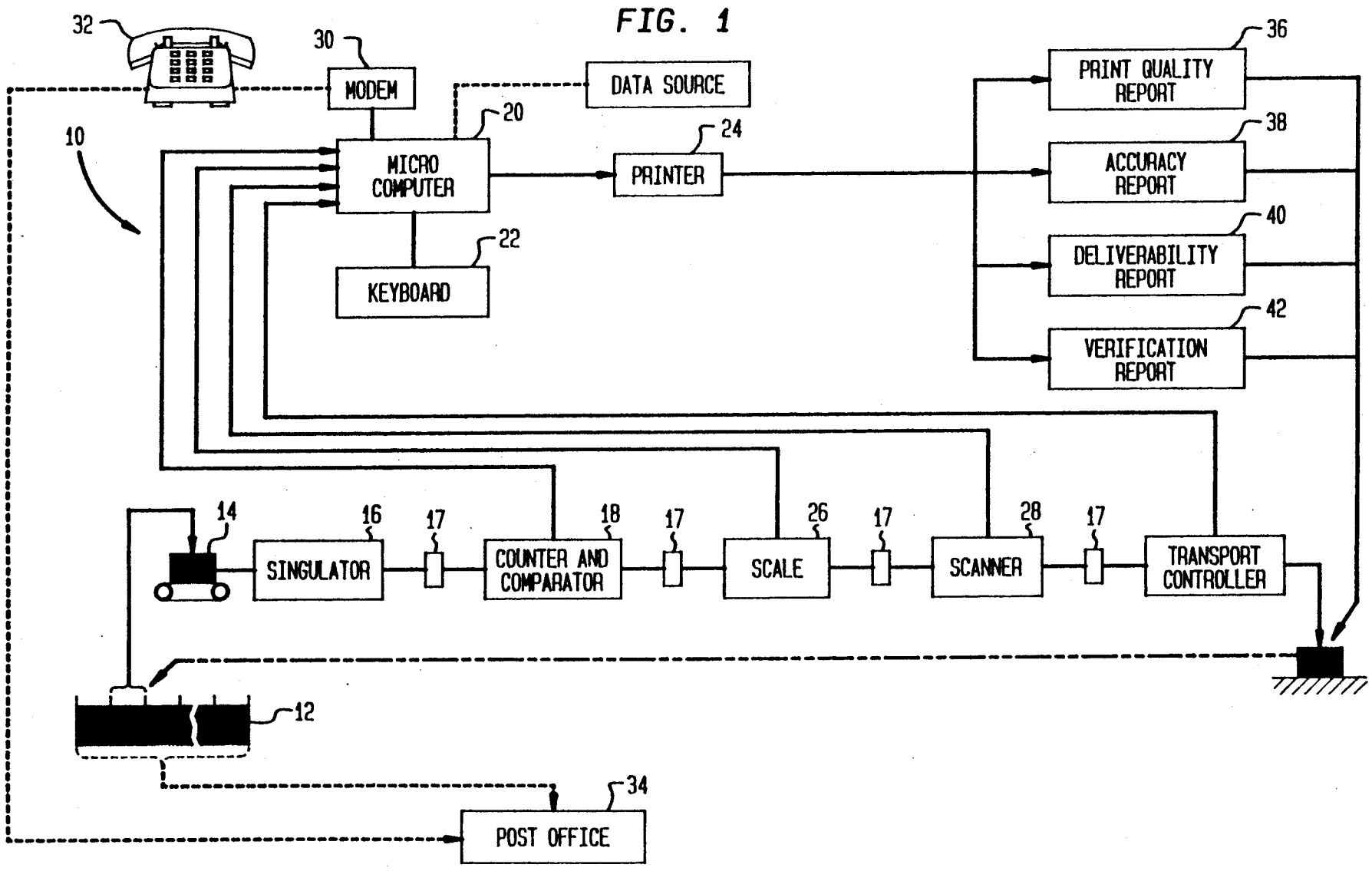
FIG. 1 is a block diagram showing the various components of the mail certification system; and, FIGS. 2-4 are flow charts that reflect the program that controls the functions of the components shown in FIG. 2.

Referring now to FIG. 1, when batch of mail is to be certified and categorized, the batch of mail is delivered to a location that carries out this function. The location may be at the Post Office, upon the premises of the mailer and operated by the mailer, or it may be at the location of an independent contractor who performs the service on behalf of both the mailer and the Post Office. A batch of mail, indicated at 12, may include a large number of mail pieces, as for example 20,000 mail pieces. A statistically determined random sample is made of the mail pieces for the purposes of sampling the batch of mail 12 and such sampled mail is isolated into a packet indicated by 14. The statistical method of sampling can be any standard procedure such as the random number tables given in the Handbook of Military Standards. By way of an example, if the batch 12 consist of 20,000 mail pieces, the packet 14 may conveniently consist of 1800 mail pieces. Such a number would give a good statistical representation of the entire batch. It will be appreciated that a statement sheet prepared by the mailer, such as a Post Office 3602 form, will accompany the batch 12. This statement sheet would disclose the volume of mail, the various classes within the mail, the different levels of pre-sort and carrier routes, the total weight of the mail, and the rates. This statement sheet will then become part of the data that will subsequently be submitted to the Post Office. It should be noted that provision has to be made to return the mail pieces of the sample to their original position in the batch 12 after categorizing and certification is complete.

The mail pieces that are part of the sample packet 14 are initially passed through a singulator 16 that will transport the mail pieces in series for further processing along a conveyor 17, such as a belt conveyor, represented by the small blocks between components. These mail pieces will be passed by a counter and comparator 18. At the counter and comparator 18 an ordinal number will be assigned to each mail piece consecutive order, and these numbers will be stored within a microcomputer 20 which is in communication with the counter and comparator so as to identify each mail piece individually. This will allow the system to track each mail piece as it is processed. The micro-computer 20 will have a data base that stores an address reference file that includes the national zip plus 4 lists and associated address correlation data. The counter comparator 18 will measure the package dimensions to determine if any mail pieces fall outside the categories that are set by the Post Office for such mail. If they are outside of the category set by the Post Office, this dimensional non-compliance will be transmitted to the microcomputer and stored in a non-compliance list. The microcomputer 20 has a keyboard 22 therein to which data may be input. For example, the class of mail for the batch of mail 12 may be input and, in assigning ordinal numbers to the mail pieces, a particular sequence of numbers may be input by the keyboard. More importantly, data from a statement sheet for the batch of mail 12, such as a form 3602 or form 3541, will be entered through the keyboard 22. Alternatively, such statement sheet data can be entered from an outside source 23 such as the mailer's main frame computer. A printer 24 is in communication with the microcomputer 20 so as to print reports which will hereinafter be described.

After a mail piece leaves the counter and comparator 18, it will be transported to a scale 26 which is in electrical communication with the microcomputer 20. The scale should be of a type that is able to weigh a mail piece rapidly and accurately. An example of such a scale is shown and described in co-pending application U.S. Ser. No. 073,790, now U.S. Pat. No. 4,778,018, which is assigned to the assignee of the instant patent application. After the weight is obtained, the weight is transmitted to the microcomputer 20 and the mail piece is then forwarded to a scanner 28. The latter will identify and read the last line of the address block, which gives the city, state and zip code and measure certain parameters of the mail piece such as print contrast, surface reflectivity, and print font style. The scanner 28 in combination with the microcomputer 20 will perform a number of functions. Firstly, the geographical distribution of the mail will be determined. This will allow the Post Office to be aware of which regional centers the mail is to be sent. The combination will also determine the accuracy of the zip or the zip+4 addressing. The lettering used to address the mail piece will be determined, i.e. the type of font used. This is useful information to the Post Office since some OCR machines are more capable of reading one type of font as opposed to a different type. The readability of the mailing address will be determined based upon the contrast and reflectivity of the mail pieces. This information will be sent to the microcomputer and stored in memory. The mail pieces will then be passed on to the transport controller whereby the mail pieces eventually will join the batch mail 12, being replaced in their original position. While such transporting is going on, certain activities are undertaken by the microprocessor. The zip codes that are determined from the mail will be compared against the national zip+4 data base and retrieved. If the zip code is not found, an indication as such is stored as undeliverable for bad zip code. In the alternative, one can compare the zip coded city and state to the written city and state address, and if there are any mismatches, the mail piece is recorded as being undeliverable. If the mail is pre-barcoded, the bar code is decoded and compared to the zip code. If there is a mismatch, again it is marked as undeliverable. If manifest mail is being processed, an accuracy analysis is made of the manifest key line.

At the end of the batch sampling plan, an OCR readability mail compliance and deliverability summary from the sampled data is prepared. Then a comparison is made between the data represented by the statement sheets and that obtained from the sample. The amount of correlation is then stored.

After the microcomputer has been uploaded with the data from the various units, it will correlate the data and cause the printer 24 to print a print quality report 36, an accuracy report 38, a deliverability report 40, and a verification report 42. The print quality report will not only indicate the quality of the printing, but the type of font used as well. The accuracy report correlates the findings of the sample to the data on the statement sheet. The deliverability report will indicate the percentage of the mail being received by the Post Office that will actually be in a condition to be delivered. The verification report will then verify the postage paid for the batch of mail.

Upon the various parameters being determined, the microcomputer will then contact the Post Office through a telephone or fax 32 that is in communication with a computer through a modem 30 when the sampling takes place away from the Post Office. Obviously, if the sampling takes place at the Post Office the reports will be on site. Upon receipt of this information by the Post Office, the Post Office will now have the ability to determine the correctness of the postage paid, forecast workloads and can accommodate its equipment and manpower based upon such a forecast. The forecast of workloads would allow the Post Office to process mail with equipment that is best able to handle the incoming mail pieces. For example, some mail pieces can only read bar codes, whereas others are capable of reading OCR. If the mail coming in has pre-printed bar codes, then the Post Office is able to process such mail using a machine that has bar code reading capability only. On the other hand, if the bar coding is non-existent or inaccurate, then the Post Office would process the mail through an OCR machine. In addition to this, various OCR machines have their own characteristics. For example, some OCR machines are capable of reading different fonts better than other OCR machines. On this basis, a particular font will be sent to an OCR machine best capable of reading such font. In addition, some OCR machines are affected by low contrast, where others are not. Consequently, if a batch of mail is received where there is low contrast, it would be sent to an OCR machine that is not so badly affected by such low contrast. Another question is reflectivity. Again, some OCR machines do not perform well with mail pieces that have high reflectivity; whereas, other machines are not affected by such. On this basis, the Post Office will have a better opportunity of preparing for the incoming mail.

After all the data has been accumulated on the sample mail pieces, the transport control then causes the sample mail to be returned to the batch 12 and redistributed into the same locations from which the mail pieces were taken. Along with such sampled mail pieces, the print quality report 36, accuracy report 38, delivery report 40, and verification report 42 will also be placed with the batch 12. Although these reports 36,38,40,42 are shown separately, it will be appreciated that the information from each can be placed on a single sheet to form a single report. Upon completion of the reinsertion of the sampled mail pieces and the various reports, the batch mail 12 will then be delivered to the Post Office along with the reports if sampling is performed outside of the Post Office. As stated previously, by the time the batch mail 12 reaches the Post Office, the Post Office will be in a position whereby it will have a good idea as to how to handle the mail, and have a certification report upon which the Post Office can rely to assure that payment accompanying the mail is correct without having to conduct manual acceptance procedures. If the payment is not correct, the Post Office can either collect for a postage shortage or the mailer's account can be debited by the microcomputer 20 for such postage due.

Figure 2:
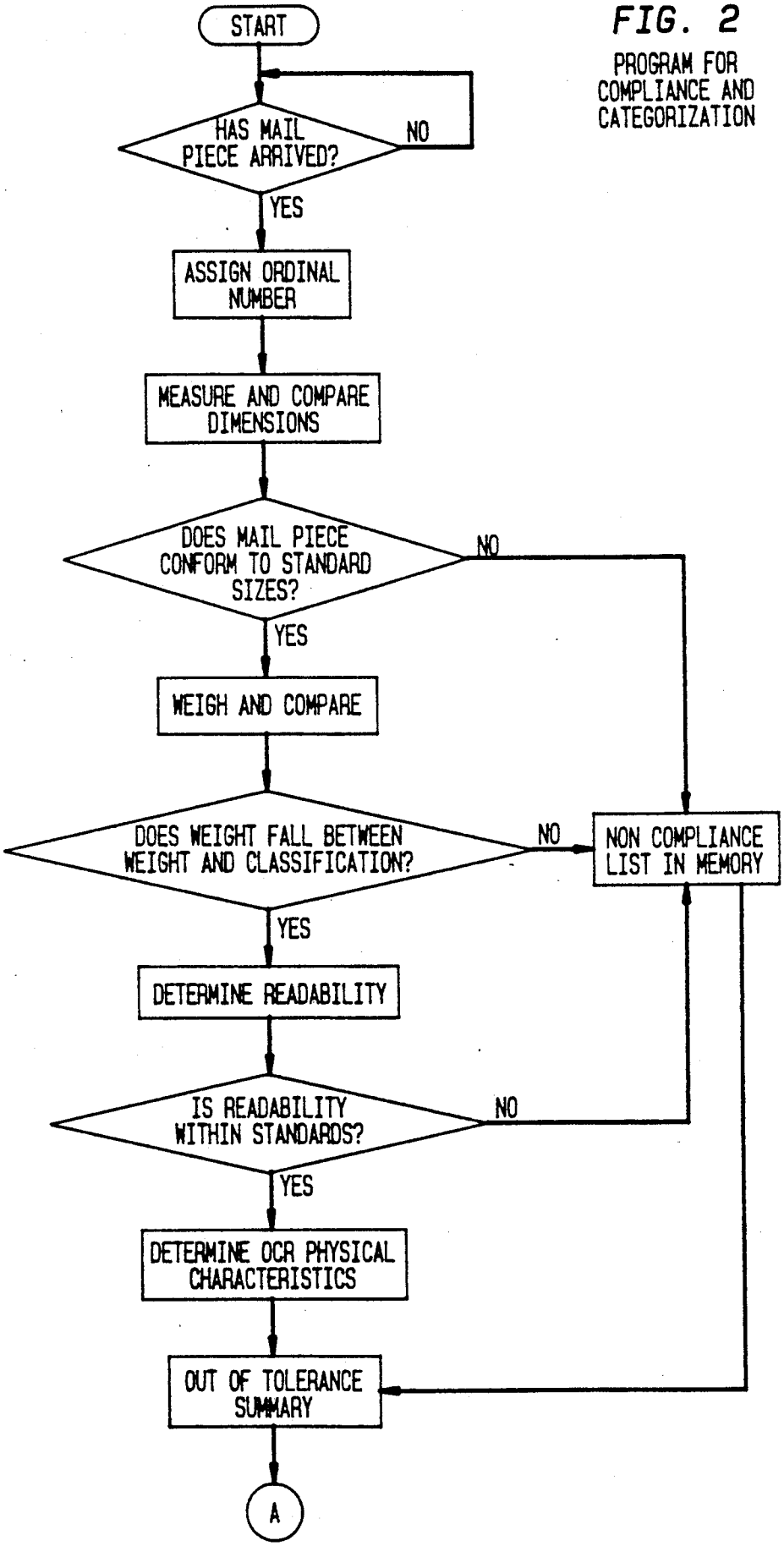
Figure 3:
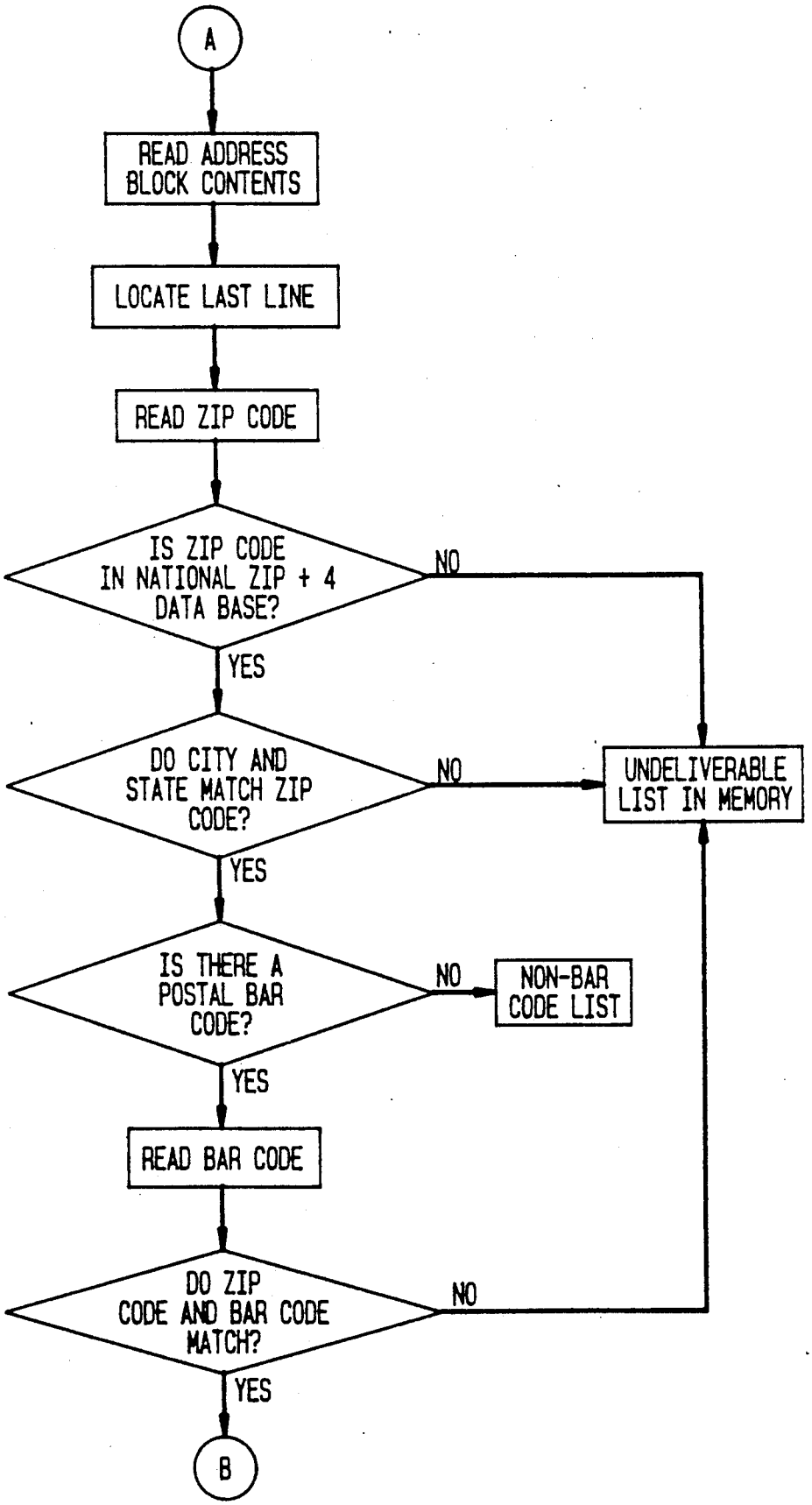
Figure 4:
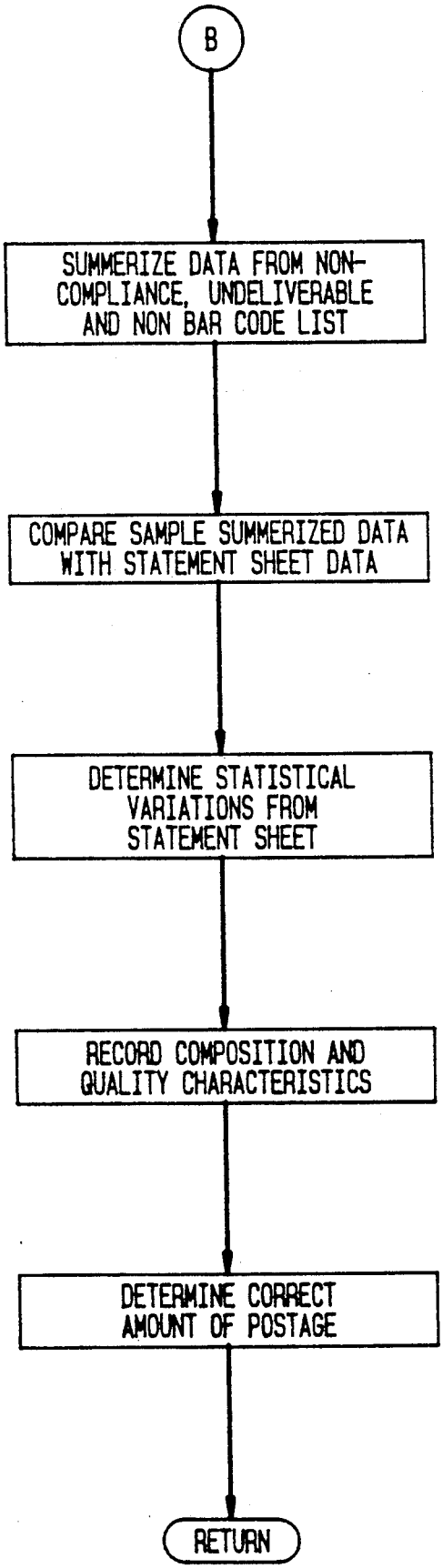

Referring now to FIGS. 2–4, a detailed description of the program that controls the functioning of the components shown in FIG. 1 will be given. Referring initially to FIG. 2, at the start an inquiry is made whether a mail piece has arrived at the singulator. If the mail piece has not arrived, there is a return, but if it has, an ordinal number is assigned that uniquely identifies each piece. These ordinal numbers are assigned in sequence in order to monitor or track each of the mail pieces. The size of each mail piece is then measured, and the dimensions are compared against the postal classification for dimensions. An inquiry is then made as to whether the mail piece conforms to the standard sizes. If the response is no, these dimensions, as well as the ordinal number of the particular mail piece, are delivered to a memory list within the microcomputer's memory. After the determination, if the piece is within the standard sizes allowed by the Post Office, the piece is then weighed and compared against the postal mail classification for that type of mail. The type of mail will have been input by the operator through the keyboard or through the outside data source input 23. The inquiry is then made whether the weight falls within the postal classification. If not, then the weight and ordinal number of that particular mail piece is again stored within a memory list for weights within the microcomputer. After the standard weight classification test, then a determination of readability is made. An inquiry is then made whether the mail piece is within OCR readability standards. Again, if it is not within the standards, this is recorded within the memory list of the microprocessor. The mail piece is then passed on. A determination is then made relative to the optical character reading physical characteristics of the address block. More specifically, determination is made as to the contrast, the reflectivity, the print font types, and the like. Upon completion of the determination of the OCR characteristics, then an out of tolerance summary of the mail batch is made, and the percent of non-compliance of the mail pieces is stored in memory. It will be noted that one mail piece may have more than one parameter for which it is out of compliance, but because of the notation of the ordinal number for each mail piece, the total number of mail pieces out of compliance will be reported. This portion of the program completes the compliance for categorization.

The next part of the program is disclosed in FIG. 3 and deals with the mail batch deliverability and certification. The address block contents are first read. The last line of the address block is located, the last line being that line which has the city, state, and zip code. The zip code is then read. An inquiry is made whether the zip code can be found in the national zip+4 data base. If it cannot, then this is stored in the undeliverable memory list within the microprocessor. An inquiry is then made as to whether the city and state match the zip code that is printed on the address line. If not, again this non-compliance is sent to the memory list. The next inquiry is whether there is a pre-printed postal bar code on the envelope. If not, this information is sent to the microprocessor so that the postal service may charge the mailer for not having the pre-printed bar code, but if there is, the pre-printed bar code is read. An inquiry is made as to whether the zip code and bar code match. If not, this information is stored within memory, but if so, then the mail piece is simply forwarded.

After all the information has been obtained from the mail pieces, the summarization of such data takes place as is described in FIG. 4. A summarization is first made as to the mail category with regard to compliance with sizes, class of mail, weights and the like in conjunction with the non-compliance lists. After this summarization is made, a comparison is made with the summary data on the statement sheet that accompanies the batch of mail and which had been entered into the microcomputer 20 through the keyboard by the operator or outside source 23. A determination is then made of the variation from the statement sheet. Following this, a quality characteristics report is made which includes such things as readability. After such report is made, a determination is made as to the correct amount of postage. As indicated, the amount of postage will be determined by whether there are OCR readable address blocks, zip codes, wrong weight for a statistical class, oversized envelopes and the like. This information will then be included in the report that is prepared following the completion of the summarization.

What has been shown and described is an apparatus and a method for authenticating mail on a statistical basis. By a statistical random selection of mail, an accurate indication as to the postage required, quality, contents, and quantity of mail can be made as well as a correlation relative to an accompanying statement sheet.

What is claimed is:

1. Apparatus for processing mail having an address, comprising:

means for obtaining a sample of mail pieces from a batch of mail pieces, means for scanning the sample mail pieces to produce data representative of at least one of the following parameters of each sample mail piece, (a) readability of the address, (b) deliverability of the mail piece, (c) dimensions of the mail piece, (d) presence on the mail piece of certain codes, (e) correct postage, congruence among mail piece printings, and means for storing said data.

2. Apparatus as claimed in claim 1, wherein further comprising means for producing data representative of plural items from paragraphs (a)-(f) of the sample mail pieces, means for categorizing the mail pieces based on the said data, and means for generating a report of the distribution of the mail pieces in categories based on said data and certifying the accuracy of the report.

3. Apparatus for certifying and categorizing a batch of mail, comprising;

means for obtaining a random statistical sample of mail pieces from a batch of mail pieces, means for individually transporting said sample mail pieces, means for identifying each of the sample mail pieces, means for weighing each sample mail piece, means for scanning the sample mall pieces to determine the address and readability of the address line of said mail pieces, and means for storing data obtained from said weighing and scanning.

4. The apparatus of claim 3 including means for identifying the class of mail for said batch of mail pieces.

5. The apparatus of claim 4 including means for determining the size of the sample mail pieces and means for comparing the determined size with post office standards.

6. The apparatus of claim 5 including means for weighing each sample mail piece and means for comparing the weight of the mail piece to post office standards.

7. The apparatus of claim 6 including means for determining the readability of the address on each sample mail piece.

8. The apparatus of claim 7 including means for determining the postage for each sample mail piece.

9. Apparatus for certifying and categorizing a batch of mail, comprising:

means for obtaining a random statistical sample of mail pieces from a batch of mail pieces, means for storing post office regulations with regard to acceptable mail sizes, weight and address readability, means for individually transporting the sample mail pieces, means for identifying each sample mail piece, means for scanning the sample mail pieces to determine the size and readability of the address line on each sample mail piece, means for comparing the obtained weight, size and readability of the sample mail pieces with the stored regulations, and means for determining the number of sample mail pieces that do not conform with the stored regulations.

10. The apparatus of claim 9 including means for identifying the class of mail of said batch of mail.

11. The apparatus of claim 10 including means for determining the postage for the sample mail pieces.

12. The apparatus of claim 11 including means for printing a report that includes postage information for the batch of mail including size, weight and postage required for said batch of mail.

13. In a system for categorizing and certifying mail, the combination comprising:

means for obtaining a random statistical sample of mail pieces from a batch of mail, means for conveying the sample mail pieces in series, means for assigning an identification number to each sample mail piece, means for measuring the dimensions of each sample mail piece and comparing them to acceptable dimensions in the postal regulations.

14. The apparatus of claim 13 including means for identifying the class of mail of said batch of mail.

15. The apparatus of claim 14 including means for identifying those sample mail pieces that do not conform in size, OCR physical characteristics and weight to the post office regulations for acceptability, whose zip code is not included within the zip plus 4 post office data base, and whose city and state do not match the zip code.

16. The apparatus of claim 15 including means for printing a report that includes postage information for the batch of mail based upon information obtained from said sample of mail pieces including size, weight, class and postage required for said batch of mail.

17. A process for increasing efficiency of a mail deliverer in the handling of batch mailings comprised of mail pieces addressed to different parties, comprising, before subjecting said batch to mail processing for delivery of the individual mail pieces to the addresses printed on each mail piece:

(a) sampling said batch to obtain a representative sample, (b) assigning an identification code to each sample mail piece, (c) determining physical parameters of each sample mail piece by subjecting same to at least one of the following steps:

(1) determining its weight, (2) determining its size, (3) determining its mail class, (4) determining the amount of postage applied, (5) determining address readability, (6) determining address print contrast, (7) determining address font type, (8) determining mail piece reflectivity at the print address, (9) reading the address,

(10) determining address deliverability,

(11) reading the address and comparing the city/state designation with the zip code,

(12) determining whether the zip code is present,

(13) determining whether a zip code+4 is present,

(14) determining whether a bar-coded address is present,

(15) determining whether a bar-coded address is present and comparing same with the human recognizable address, (d) generating a report summarizing the results of step (c) extended to the batch, (e) restoring the sample mail pieces to said batch, and (f) delivering the mail batch together with a copy of said report to the mail deliverer.

18. A process as claimed in claim 17, wherein step (a) is carried out to provide a statistically valid sample packet of mail pieces of the batch.

19. A process as claimed in claim 18, wherein the batch is initially accompanied by a statement sheet summarizing the batch contents, and the report of step (d) includes:

i. a listing of discrepancies between the statement sheet contents and the results of carrying out step (c), ii. a categorization of the batch mailing by at least one of the said parameters.

20. A process as claimed in claim 19, wherein steps (a) through (e) are carried out by an entity independent of the source of the batch and the mail deliverer, and the report of step (d) includes a certification of the statement sheet contents and any discrepancies, whereby the mail deliverer can eliminate its own pre-processing and checking procedures.

21. Method of certifying and categorizing a batch of mail, the steps comprising:

(a) obtaining a random sample of mail pieces from a batch of mail pieces, (b) individually transporting said sample mail pieces, (c) identifying each of the sample mail pieces, (d) weighing each sample mail piece, (e) scanning the sample mail pieces to determine the address and readability of the address line, of said mail pieces and (d) and storing the data obtained from steps (e).

22. The method of claim 21 including the steps of identifying the class of mail for said batch of mail pieces.

23. The method of claim 22 including the steps of determining the size of the sample mail pieces and comparing the determined size with post office mail size standards.

24. The method of claim 23 including the steps of weighing each mail piece and comparing the weight of the mail piece to post office mail weights standards.

25. The method of claim 24 including the step of determining the readability of the address on each sample mail piece.

26. The method of claim 25 including the step of determining the postage for each sample mail piece.

27. Method of certifying and categorizing a batch of mail, the steps comprising:

obtaining a random statistical sample of mail pieces from a batch of mail pieces, storing post office regulations with regard to acceptable mail sizes, weight and address readability, individually transporting the sample mail pieces, identifying each sample mail piece, weighing each sample mail piece, scanning the mail pieces to determine the size and readability of the address line on each sample mail piece, comparing the obtained weight, size and readability of the sample mail pieces with the stored regulations, and determining the number of sample mail pieces that do not conform with the stored regulations.

28. The method of claim 27 including the step of identifying the class of mail of said batch of mail.

29. The method of claim 28 including the step of determining the postage for the sample mail pieces.

30. The method of claim 29 including the step of printing a report that includes postage information for the batch of mail including size, weight and postage required for said batch of mail.

31. Method of categorizing and certifying mail, the steps comprising:

obtaining a random statistical sample of mail pieces from a batch of mail, conveying the sample mail pieces in series, assigning an identification number to each sample mail piece, measuring the dimensions of each sample mail piece and comparing them to acceptable dimensions in the postage regulations, weighing and comparing the weight of each sample mail piece against a standard, determining the OCR physical characteristics of each sample mail piece, identifying and reading the last line of each sample mail piece address, reading the zip code of each sample mail piece, determining if the zip code is included in the national zip+4 data base, and determining if the city and state printed on each sample mail piece matches the zip code printed thereon.

32. The method of claim 31 including the step of identifying the class of mail of said batch of mail.

33. The method of claim 32 including the steps of identifying those sample mail pieces that do not conform in size, OCR physical characteristics and weight to the post office regulations for acceptability, whose zip code is not included within the zip plus 4 post office data base, and whose city and state do not match the zip code.

34. The method of claim 33 including the step of printing a report that includes postage information for the batch of mail based upon information obtained from said sample of mail pieces including size, weight, class and postage required for said batch of mail.

* * * * *